US007880111B2

(12) United States Patent
Inoue et al.

(10) Patent No.: US 7,880,111 B2
(45) Date of Patent: Feb. 1, 2011

(54) SWITCHGEAR AND METHOD OF FABRICATING THE SAME

(75) Inventors: Naoaki Inoue, Tokyo (JP); Masahiro Arioka, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 12/294,382

(22) PCT Filed: Mar. 23, 2007

(86) PCT No.: PCT/JP2007/056062

§ 371 (c)(1),
(2), (4) Date: Sep. 24, 2008

(87) PCT Pub. No.: WO2007/116661

PCT Pub. Date: Oct. 18, 2007

(65) Prior Publication Data

US 2009/0134125 A1 May 28, 2009

(30) Foreign Application Priority Data

Mar. 27, 2006 (JP) ..... 2006-084479

(51) Int. Cl.
*H01H 33/66* (2006.01)

(52) U.S. Cl. ..... 218/136

(58) Field of Classification Search ..... 218/134–139
See application file for complete search history.

(56) References Cited

FOREIGN PATENT DOCUMENTS

| | | | |
|---|---|---|---|
| JP | 49-30878 | A | 3/1974 |
| JP | 50-25322 | Y1 | 7/1975 |
| JP | 55-108128 | A | 8/1980 |
| JP | 56-5343 | | 1/1981 |
| JP | 56-73827 | A | 6/1981 |
| JP | 58-169633 | | 11/1983 |
| JP | 62-131335 | | 8/1987 |
| JP | 2002-358861 | A | 12/2002 |
| JP | 2003-31090 | A | 1/2003 |
| JP | 2005-197061 | A | 7/2005 |
| JP | 2005-276472 | A | 10/2005 |

OTHER PUBLICATIONS

JP2005-197061, Complex Insulating Switchgear, Jul. 21, 2005, machine translation of Detailed Description.*
International Search Report (PCT/ISA/210), Jun. 18, 2007.

* cited by examiner

*Primary Examiner*—Ramon M Barrera
(74) *Attorney, Agent, or Firm*—Buchanan Ingersoll & Rooney PC

(57) ABSTRACT

A switchgear including a vacuum valve which prevents partial discharges infallibly and whose reliability is high, and a method of fabricating the same are obtained.

In a vacuum valve 1 wherein a stationary electrode 1*a* and a movable electrode 1*b* are disposed within a vacuum vessel 2 which is constituted by a metal flange 2*a* as well as a metal tube 2*e* and an insulating tube 2*b*, and wherein a resin mold 3 is applied onto the outer peripheral surface of the vacuum vessel 2; coiled metal-made shields 4*a* and 4*b*, in each of which a coiled metal wire is brought into an annular shape, are retained on the outer peripheral surface of the vacuum vessel 2 so as to relax the electric fields of the electric field relaxation-requiring parts 21*d* of the vacuum vessel 2.

12 Claims, 3 Drawing Sheets

SECTION B-B

SWITCHGEAR AND METHOD OF FABRICATING THE SAME

TECHNICAL FIELD

This invention relates to a switchgear and a method of fabricating the same, more particularly a switchgear which includes a vacuum valve with the outer peripheral surface of a vacuum vessel molded with a resin and a method of fabricating the same, and it relates specifically to thermal stress relaxation and electric field relaxation which arrest the occurrences of cracks, partial discharges, etc. that develop in the resin mold when this mold has undergone a temperature change.

BACKGROUND ART

A vacuum valve has its insulating performance ensured in such a way that the outer peripheral surface of a vacuum vessel having a movable electrode and a stationary electrode inside is molded with a resin, for example, an epoxy resin being an outer peripheral insulator (hereinbelow, termed "resin molding").

In general, it is practiced to apply thermal stress relaxation members to only required parts, i.e., parts requiring thermal stress relaxation, not to all the outer peripheral surface of a vacuum vessel 1A (refer to, for example, Patent Document 1). Signs 3B in FIG. 8 of Patent Document 1 denote room-temperature vulcanizing type silicone rubber [hereinbelow, termed "RTV (Room Temperature Vulcanizable) rubber"] being the stress relaxation members which are applied as coatings so as to respectively cover thermal stress concentration parts 2C being the thermal stress relaxation-requiring parts of the outer peripheral surface of the vacuum vessel 1A. Incidentally, there are disposed metal-made flanges 2*a* which block up both the ends of a vacuum vessel 2, and a ceramics-made insulating tube 2*b* which forms the body portion of the vacuum vessel 2.

The RTV rubber or the like is a liquefied and viscous rubber, which is applied as the coatings to the thermal stress concentration parts 2*c* surrounding the outer peripheral surface of the vacuum vessel 2, to appropriate thicknesses, and is then vulcanized. Since the coating operation needs to be performed with scrupulous care so as not to involve air bubbles causing partial discharges, into the RTV rubber, much labor and a long time have been expended on the execution of the thermal stress relaxation members.

Besides, the RTV rubber differs in thermal expansion coefficient from the epoxy resin or the like which insulates the outer peripheral surface of the vacuum vessel. It is therefore apprehended that, when the vacuum vessel becomes a normal temperature of about 20° C. after having been molded at a high temperature exceeding 100° C., gaps will appear between the RTV rubber and the epoxy resin, to form causes for partial discharges.

Patent Document 1: JP-A-2002-358861 (FIG. 8)

DISCLOSURE OF THE INVENTION

Problems that the Invention is to Solve

This invention is intended to solve the several problems stated above, and to obtain a switchgear including a vacuum valve which infallibly prevents partial discharges and which is high in reliability, and a method of fabricating the same.

Means for Solving the Problems

A switchgear according to this invention consists, in a switchgear including a vacuum valve in which a plurality of electrodes movable relative to each other are disposed within a vacuum vessel constituted by a conductive member and an insulating member and in which a resin mold is applied onto the outer peripheral surface of the vacuum vessel, in that an annular electrostatic shield member which contracts in its radial direction is retained on an outer peripheral surface of the vacuum vessel, thereby to relax an electric field of an electric field relaxation-requiring part of the vacuum vessel.

Advantages of the Invention

In accordance with this invention, it is possible to obtain a switchgear including a vacuum valve which prevents partial discharges infallibly and whose reliability is high, and a method of fabricating the same.

This invention can be utilized for thermal stress relaxation for arresting the appearance of the cracks of a resin mold, and for electric field relaxation for arresting the occurrences of discharges.

DESCRIPTION OF REFERENCE NUMERALS AND SIGNS

1 vacuum valve, 2 vacuum vessel, 2*a* metal flange, 2*b* insulating tube, 2*e* metal tube, 3 resin mold (external insulator), 4*a*, 4*b* coiled metal shields, 5 thermal stress relaxation member (RTV rubber), 6 conductive or semi-conductive coating material, 7 coupling agent, 21*c* thermal stress concentration part (thermal stress relaxation-requiring part), 21*d* electric field concentration part (electric field relaxation-requiring part).

BEST MODE FOR CARRYING OUT THE INVENTION

Embodiment 1

Figure 1:
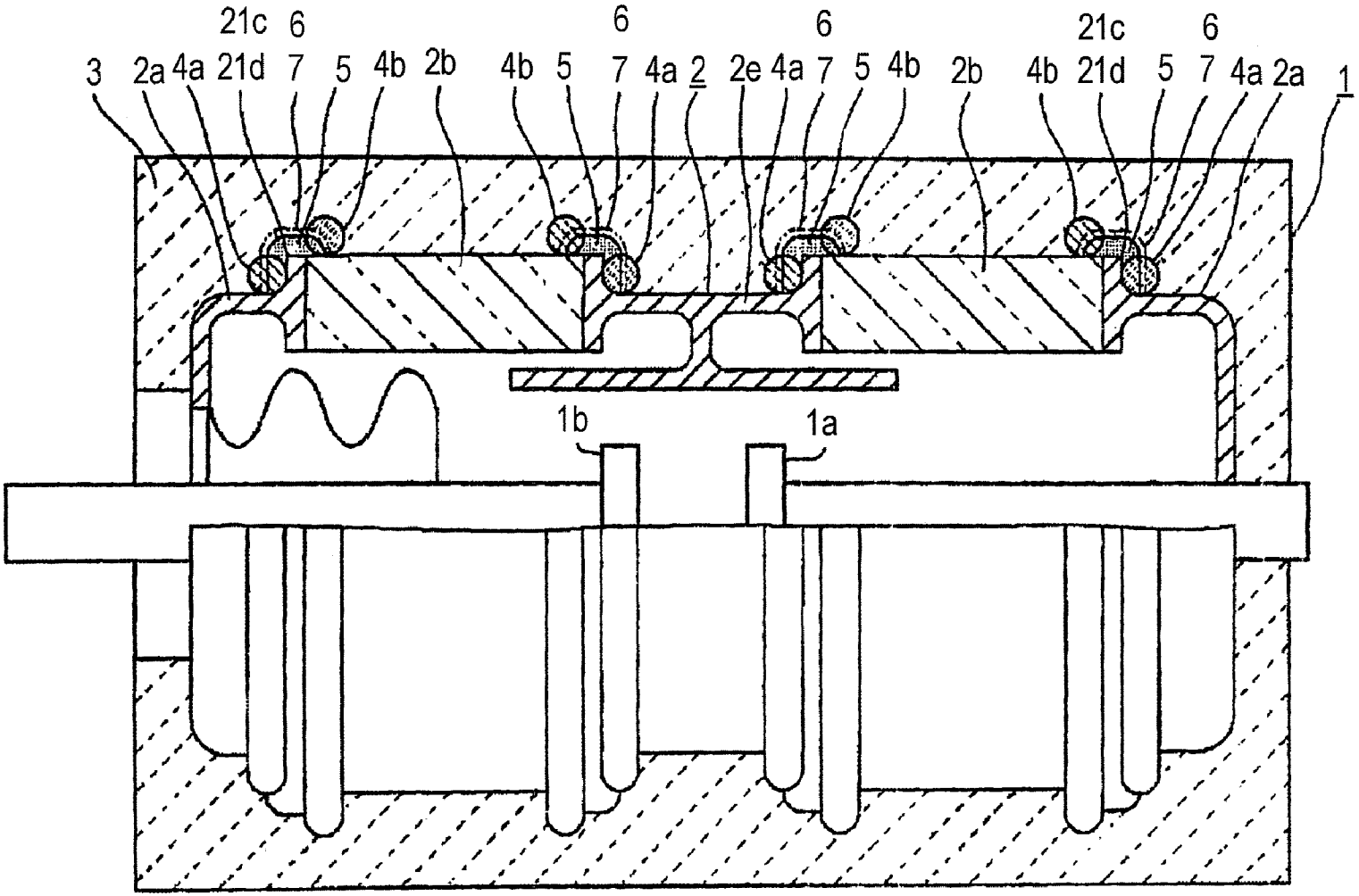
FIG. 1 It is a sectional view, partially cut away, showing the configuration of a switchgear which includes a vacuum valve in Embodiment 1 according to this invention.
Figure 2A:
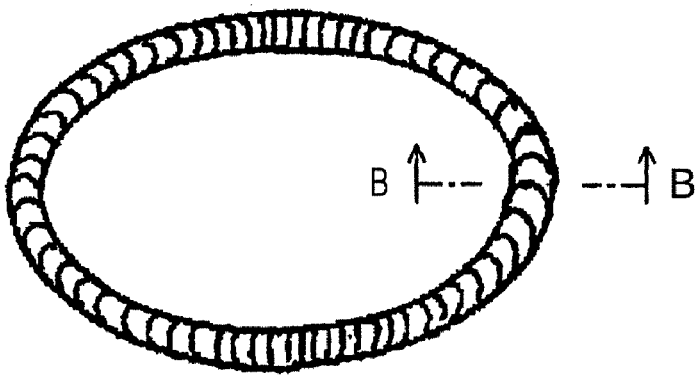
FIG. 2 It depicts a perspective view, a sectional view and a plan view of a shield member in Embodiment 1 according to this invention.
Figure 2B:
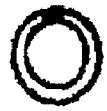
Figure 2C:
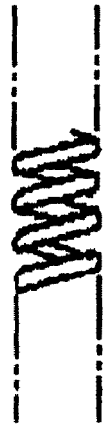

Embodiment 1 according to this invention will be described in conjunction with FIGS. 1 and 2. FIG. 1 is a sectional view, partially cut away, showing the configuration of a switchgear which includes a vacuum valve in Embodiment 1. FIG. 2 depicts a perspective view, a sectional view and a partial enlarged plan view showing the configuration of a shield member in Embodiment 1. FIG. 2(*a*) depicts the perspective view, FIG. 2(*b*) depicts the sectional view taken along line B-B in FIG. 2(*a*), and FIG. 2(*c*) depicts the partial enlarged plan view.

Referring to FIG. 1, the vacuum valve 1 is configured of a stationary electrode 1*a* and a movable electrode 1*b*, a vacuum vessel 2 which is configured of metal-made flanges 2*a*, a metal tube 2*e* and ceramics-made insulating tubes 2*b* and which accommodates the electrodes 1*a* and 1*b* therein, and a resin mold which is an outer peripheral insulator covering the outer peripheral surface of the vacuum vessel 2. Sign 21*c* denotes the thermal stress concentration part of the vacuum vessel 2, and sign 21*d* the electric field concentration part of the vacuum vessel 2.

The edge part 21*d* which protrudes in the outer peripheral direction of the vacuum vessel 2, for example, exists as the part of the outer peripheral surface of the vacuum vessel 2 corresponding to that position of the resin mold 3 which is apprehended to become a high electric field due to electric field concentration and to incur a partial discharge or the like drawback, that is, a part requiring electric field relaxation.

In order to relax the electric fields of such parts requiring the electric field relaxation, coiled metal-made shields 4*a* in each of which a coiled metal wire is brought into an annular shape are retained on the outer peripheral surfaces of the metal-made flanges 2*a* vicinal to the connection parts between these metal-made flanges 2*a* and the corresponding insulating tubes 2*b*, and the metal tube 2*e* vicinal to the connection parts between this metal tube 2*e* and the insulating tubes 2*b*.

The coiled metal-made shield 4*a* is such that a coil element which has a coil outside diameter being about 1/10 of the outside diameter of each of both end parts in the vacuum vessel 2 that is configured of the metal flanges 2*a*, the metal tube 2*e* and the ceramics-made insulating tubes 2*b* is formed of the comparatively fine metal wire, and that the coil element is formed into an annular member which has an inside diameter being smaller than the outside diameter of each of both end parts in the vacuum vessel 2 that includes the metal flanges 2*a*, in the free state thereof. As has its section shown in FIGS. 1 and 2(*b*) and its enlarged plan view shown in FIG. 2(*c*), the coiled metal-made shield 4*a* thus formed is fitted onto and joined with the metal flange 2*a* constituting the vacuum vessel 2, in a state where it is generally arranged in a direction perpendicular to the drawing sheet of FIG. 1. The fitting of the coiled metal-made shield 4*a* onto the metal flange 2*a* is performed in such a way that this coiled metal-made shield 4*a* is pulled against an elastic force in the direction of radially enlarging it, thereby to make the inside diameter of this coiled metal-made shield 4*a* larger than the outside diameter of the metal flange 2*a* constituting the vacuum vessel 2. The coiled metal-made shield 4*a* fitted on the metal flange 2*a* is held in pressed touch with the outer peripheral surface of the metal flange 2*a* constituting the vacuum vessel 2, and over its whole periphery, by the contractive force thereof. In addition, the coiled metal-made shield 4*a* is electrically coupled with the metal flange 2*a*.

The coiled metal-made shield 4*a* is disposed so as to protrude in the outer peripheral direction of the vacuum vessel 2 beyond the edge part 21*d* protrusive in the outer peripheral direction, and this coiled metal-made shield 4*a* and the metal-made flange 2*a* are electrically connected, whereby the electric field of the edge part 21*d* can be relaxed, and the occurrence of the partial discharge can be suppressed.

Besides, at the electric field relaxation-requiring parts formed of the edge parts 21*d* and in order to relax the electric fields around these parts, coiled metal-made shields 4*b* in each of which a coiled metal wire is brought into an annular shape are retained on the outer peripheral surfaces of the insulating tubes 2*b* vicinal to the connection parts between the metal-made flanges 2*a* and these insulating tubes 2*b*, and the insulating tubes 2*b* vicinal to the connection parts between this metal tube 2*e* and these insulating tubes 2*b*.

Likewise to the coiled metal-made shield 4*a*, the coiled metal-made shield 4*b* is such that a coil element which has a coil outside diameter being about 1/10 of the outside diameter of each of intermediate parts in the vacuum vessel 2 that includes the insulating tubes 2*b* is formed of the comparatively fine metal wire, and that the coil element is formed into an annular member which has an inside diameter being smaller than the outside diameter of each of the intermediate parts in the vacuum vessel 2 that includes the insulating tubes 2*b*, in the free state thereof. As has its section shown in FIG. 1, the coiled metal-made shield 4*b* thus formed is fitted onto and joined with the insulating tube 2*b* constituting the vacuum vessel 2, in a state where it is generally arranged in the direction perpendicular to the drawing sheet of FIG. 1. The fitting of the coiled metal-made shield 4*b* onto the insulating tube 2*b* is performed in such a way that this coiled metal-made shield 4*b* is pulled against an elastic force in the direction of radially enlarging it, thereby to make the inside diameter of this coiled metal-made shield 4*b* larger than the outside diameter of the insulating tube 2*b* constituting the vacuum vessel 2. The coiled metal-made shield 4*b* fitted on the insulating tube 2*b* is held in pressed touch with the outer peripheral surface of the insulating tube 2*b* constituting the vacuum vessel 2, and over its whole periphery, by the contractive force thereof. In addition, the coiled metal-made shield 4*b* is electrically coupled with the metal tube 2*e*.

The coiled metal-made shield 4*b* is disposed so as to protrude in the outer peripheral direction of the vacuum vessel 2 beyond the edge part 21*d* protrusive in the outer peripheral direction, and this coiled metal-made shield 4*b* and the metal-made flange 2*a* are electrically connected, whereby the electric field around the edge part 21*d* being the electric field relaxation-requiring part can be further relaxed, and the occurrence of the partial discharge can be arrested.

In addition to the above, the edge part 21*c* which protrudes in the outer peripheral direction of the vacuum vessel 2, for example, exists as the part of the outer peripheral surface of the vacuum vessel 2 corresponding to that position of the resin mold 3 which is apprehended to incur a crack or the like drawback due to thermal stress concentration, that is, a part requiring thermal stress relaxation. In order to relax thermal stresses, such thermal stress relaxation-requiring parts are coated with an RTV rubber 5 forming thermal stress relaxation members, whereupon the coiled metal-made shields 4*a* and 4*b* are retained.

The RTV rubber 5 is applied as the coatings, whereby the cracks or the like drawback can be prevented by the thermal stress relaxation of the resin mold 3, and the coiled metal-made shields 4*a* and 4*b* are disposed and are electrically connected with the metal-made flanges 2*a*, whereby even in a case where gaps have appeared between the RTV rubber 5 and the resin mold 3, the electric fields of the parts around the edge parts 21*d* and the gap parts as form the electric field relaxation-requiring parts can be relaxed, and the occurrences of the partial discharges can be arrested.

Further, the edge part 21*c* which protrudes in the outer peripheral direction of the vacuum vessel 2, for example, exists as the part of the outer peripheral surface of the vacuum vessel 2 corresponding to that position of the resin mold 3 which is apprehended to incur the crack or the like drawback due to the thermal stress concentration, that is, a part requiring thermal stress relaxation. In order to relax thermal stresses, such thermal stress relaxation-requiring parts are coated with the RTV rubber 5 forming the thermal stress relaxation members, whereupon the coiled metal-made shields 4*a* and 4*b* are retained before the vulcanization of the RTV rubber 5 in such a manner that parts of these coiled metal-made shields 4*a* and 4*b* are embedded in the RTV rubber 5.

The RTV rubber 5 is applied as the coatings, whereby an effect equivalent to the above is attained regarding the prevention of the cracks or the like drawbacks, by the thermal stress relaxation of the resin mold 3, and the coiled metal-made shields 4*a* and 4*b* are disposed still nearer to the edge parts 21*d* and are electrically connected with the metal-made flanges 2*a*, whereby an effect equivalent to the above is attained regarding the electric field relaxation of the gap parts, and besides, the electric fields around the edge parts 21*d* being the electric field relaxation-requiring parts can be relaxed still more, and the occurrences of the partial discharges can be arrested.

Besides, the RTV rubber 5 is set as a paintable type which permits painting onto the surface of this RTV rubber 5 after the vulcanization thereof, and a conductive or semi-conductive coating material 6 with which an intenser adhesive force for the epoxy is attained than for the RTV rubber is applied onto, at least, those parts of the outer peripheral surfaces of the RTV rubber 5 which come into touch with the coiled metal-made shields 4*a* and 4*b*, after the vulcanization, so as to communicate with the outer peripheral surfaces of the metal flanges 2*a*.

The conductive or semi-conductive coating material 6 is applied as coatings, whereby even in the case where the gaps have appeared between the RTV rubber 5 and the resin mold 3, the coating material 6 applied so as to communicate with the outer peripheral surfaces of the metal flanges 2*a* adheres onto the side of the resin mold 3, so that the electric fields of the gap parts can be relaxed, and the occurrences of the partial discharges can be arrested.

On the other hand, the edge part 21*c* which protrudes in the outer peripheral direction of the vacuum vessel 2, for example, exists as the part of the outer peripheral surface of the vacuum vessel 2 corresponding to that position of the resin mold 3 which is apprehended to incur the crack or the like drawback due to the thermal stress concentration, that is, the part requiring the thermal stress relaxation. In order to relax thermal stresses at such thermal stress relaxation-requiring parts, the connection parts between the metal-made flanges 2*a* and the insulating tubes 2*b* are coated with the RTV rubber 5 of the paintable type which permits the painting onto the surface of this RTV rubber 5 after the vulcanization thereof, and after the vulcanization of the RTV rubber 5, the outer peripheral surfaces of the RTV rubber 5 of the paintable type are coated with a coupling agent 7 which joins the RTV rubber 5 and the epoxy resin mold 3, so as to communicate with the outer peripheral surfaces of the insulating tubes 2*b*.

The thermal stresses of the edge parts 21*c* which protrude in the outer peripheral direction of the vacuum vessel 2 and which form the thermal stress relaxation-requiring parts are relaxed by the RTV rubber 5, whereby the cracks or the like drawbacks are prevented, and the RTV rubber 5 and the resin mold 3 are joined by the coupling agent 7, whereby the appearance of the gaps forming the cause of the partial discharges between the RTV rubber 5 and the resin mold 3 can be arrested.

Incidentally, although the aspect where the metal-made shields 4*a* and 4*b* are disposed as electrostatic shield members has been illustrated in FIGS. 1 and 2, the electrostatic shield members may be made of annular members each of which has an electric conductivity and each of which self-contracts in the radial direction of the vacuum valve 1. Any desired means can be employed as being equivalent to each of the metal-made shields 4*a* and 4*b*, as long as it is an annular member being expansible and contractible in the radial direction and the peripheral direction, such as a) conductive plastics, b) a corrugated plate/corrugated wire (formed of a metal stripe, a metal wire or conductive plastics), or c) a C-shaped ring-stripe metal wire having some butt gap.

(1A) In accordance with Embodiment 1 according to this invention, in a switchgear including a vacuum valve 1 wherein a plurality of electrodes 1*a* and 1*b* movable relative to each other are disposed within a vacuum vessel 2 which is constituted by a conductive member including a metal flange 2*a* and a metal tube 2*e* and an insulating member including an insulating tube 2*b*, and wherein a resin mold 3 is applied onto the outer peripheral surface of the vacuum vessel 2; annular electrostatic shield members being electrically conductive and self-contracting in the radial direction of the vacuum valve 1, as are formed of coiled metal-made shields 4*a* and 4*b* in each of which a coiled metal wire is brought into an annular shape, or the likes are retained on the outer peripheral surface of the vacuum vessel 2, so as to relax the electric fields of the electric field relaxation-requiring parts 21*d* of the vacuum vessel 2. It is therefore possible to obtain a switchgear including the vacuum valve 1 which prevents partial discharges infallibly and whose reliability is high, owing to the annular electrostatic shield members being electrically conductive and self-contracting in the radial direction of the vacuum valve 1, as are formed of the coiled metal-made shields 4*a* and 4*b*, or the likes which are retained on the outer peripheral surface of the vacuum vessel 2.

More specifically, the switchgear is configured including the vacuum valve 1 wherein the stationary electrode 1*a* and the movable electrode 1*b* are disposed within the vacuum vessel 2 in which the metal flange 2*a*, the metal tube 2*e* and the insulating tube 2*b* are connected, and wherein the resin mold 3 is applied onto the outer peripheral surface of the vacuum vessel 2, characterized in that the annular electrostatic shield members being electrically conductive and self-contracting in the radial direction of the vacuum valve 1, as are formed of the coiled metal-made shields 4*a* and 4*b* in each of which the coiled metal wire is brought into the annular shape, or the likes, are retained on the outer peripheral surfaces of the connection parts between the metal flange 2*a* and the insulating tube 2*b* and between the metal tube 2*e* and the insulating tube 2*b*, and in the vicinities of the connection parts between the metal flange 2*a* and the insulating tube 2*b* and between the metal tube 2*e* and the insulating tube 2*b*, on the outer peripheral surfaces of the metal flange 2*a* and the metal tube 2*e*, and that the resin mold 3 is thereafter applied onto the outer peripheral surface of the vacuum vessel 2.

Accordingly, the annular electrostatic shield members being electrically conductive and self-contracting in the radial direction of the vacuum valve 1, as are formed of the coiled metal-made shields 4*a* and 4*b* or the likes are disposed, and they are electrically connected with the metal-made flange 2*a*, whereby the electric fields of the edge parts 21*d* can be relaxed, and the occurrences of the partial discharges can be arrested.

(1B) In accordance with Embodiment 1 according to this invention, in the configuration in the above item (1A), the annular electrostatic shield members being electrically conductive and self-contracting in the radial direction of the vacuum valve 1, as are formed of the coiled metal-made shields 4*a* and 4*b* in each of which the coiled metal wire is brought into the annular shape, or the likes, are joined onto the outer peripheral surface of the vacuum vessel 2 by the contractive forces of the annular electrostatic shield members being electrically conductive and self-contracting in the radial direction of the vacuum valve 1, as are formed of the coiled metal-made shields 4*a* and 4*b* retained in pressed touch with the outer peripheral surface of the vacuum vessel 2, or the likes. It is therefore possible to obtain a switchgear including the vacuum valve 1 which prevents the partial discharges infallibly and whose reliability is high, owing to the coiled metal-made shields 4*a* and 4*b* retained in pressed touch with the outer peripheral surface of the vacuum vessel 2.

More specifically, in the vacuum valve 1 defined in the above item (1A), the switchgear is configured including the vacuum valve 1 characterized in that the annular electrostatic shield members being electrically conductive and self-contracting in the radial direction of the vacuum valve 1, as are formed of the coiled metal-made shields 4*a* and 4*b* in each of which the metal wire coiled so as to have an inside diameter larger than the outside diameter of the insulating tube 2*b* is brought into the annular shape, or the likes, are retained in pressed touch with the vicinities of the connection parts between the metal flange 2*a* and the insulating tube 2*b* and between the metal tube 2*e* and the insulating tube 2*b*, on the outer peripheral surface of the insulating tube 2*b*, that the annular electrostatic shield members being electrically conductive and self-contracting in the radial direction of the vacuum valve 1, as are formed of the coiled metal-made shields 4*a* and 4*b* retained in the vicinities of the connection parts between the metal flange 2*a* and the insulating tube 2*b* and between the metal tube 2*e* and the insulating tube 2*b*, on the outer peripheral surfaces of the metal flange 2*a* and the metal tube 2*e*, or the likes, are electrically connected, and that the resin mold 3 is thereafter applied onto the outer peripheral surface of the vacuum vessel 2.

Accordingly, the annular electrostatic shield members being electrically conductive and self-contracting in the radial direction of the vacuum valve 1, as are formed of the coiled metal-made shields 4*a* and 4*b* or the likes are retained in pressed touch with the connection parts between the metal flange 2*a* and the insulating tube 2*b* and between the metal tube 2*e* and the insulating tube 2*b*, on the outer peripheral surface of the insulating tube 2*b*, thereby to dispose the annular electrostatic shield members being electrically conductive and self-contracting in the radial direction of the vacuum valve 1, as are formed of the coiled metal-made shields 4*a* and 4*b* or the likes, and they are electrically connected with the metal-made flange 2*a*, whereby the electric fields of the edge parts 21*d* can be relaxed, and the occurrences of the partial discharges can be arrested.

(1C) In accordance with Embodiment 1 according to this invention, in the configuration in the above item (1A) or the above item (1B), the annular electrostatic shield members being electrically conductive and self-contracting in the radial direction of the vacuum valve 1, as are formed of the coiled metal-made shields 4*a* and 4*b* or the likes, are retained on silicone rubber members which are made of an RTV rubber 5 vulcanized and molded around the connection parts between the conductive member including the metal flange 2*a* and the metal tube 2*e* and the insulating member including the insulating tube 2*b*. It is therefore possible to obtain a switchgear including the vacuum valve 1 which prevents the partial discharges infallibly and whose reliability is high, owing to the annular electrostatic shield members being electrically conductive and self-contracting in the radial direction of the vacuum valve 1, as are formed of the coiled metal-made shields 4*a* and 4*b* retained on the silicone rubber members which are made of the RTV rubber 5 vulcanized and molded around the connection parts between the conductive member including the metal flange 2*a* and the metal tube 2*e* and the insulating member including the insulating tube 2*b*, on the outer peripheral surface of the vacuum vessel 2, or the likes.

More specifically, the switchgear is configured including the vacuum valve 1 defined in the above item (1A) or the above item (1B), characterized in that, after the RTV rubber 5 has been applied as coatings around the connection parts between the metal flange 2*a* and the insulating tube 2*b* and between the metal tube 2*e* and the insulating tube 2*b*, the annular electrostatic shield members being electrically conductive and self-contracting in the radial direction of the vacuum valve 1, as are formed of the coiled metal-made shields 4*a* and 4*b* or the likes, are retained after the vulcanization of the RTV rubber 5, and that the resin mold 3 is applied onto the outer peripheral surface of the vacuum vessel 2 after the retention of the annular electrostatic shield members being electrically conductive and self-contracting in the radial direction of the vacuum valve 1, as are formed of the coiled metal-made shields 4*a* and 4*b* or the likes.

Accordingly, in addition to the advantage stated in the above item (1A) or the above item (1B), the thermal stresses of edge parts 21*c* can be relaxed, and the appearance of cracks or the like drawbacks can be arrested, owing to the RTV rubber 5.

(1D) In accordance with Embodiment 1 according to this invention, in the configuration in the above item (1A) or the above item (1B), the silicone rubber members made of the RTV rubber 5 are disposed, the RTV rubber 5 being vulcanized and molded around the connection parts between the conductive member including the metal flange 2*a* and the metal tube 2*e* and the insulating member including the insulating tube 2*b*, in a state where parts of the annular electrostatic shield members being electrically conductive and self-contracting in the radial direction of the vacuum valve 1, as are formed of the coiled metal-made shields 4*a* and 4*b* or the likes, are embedded in the RTV rubber 5. It is therefore possible to obtain a switchgear including the vacuum valve 1 which prevents the partial discharges infallibly and whose reliability is high, owing to the annular electrostatic shield members being electrically conductive and self-contracting in the radial direction of the vacuum valve 1, as are formed of the coiled metal-made shields 4*a* and 4*b* retained in the state where they are partially embedded in the silicone rubber members made of the RTV rubber 5 which is vulcanized and molded around the connection parts between the conductive member including the metal flange 2*a* and the metal tube 2*e* and the insulating member including the insulating tube 2*b*, on the outer peripheral surface of the vacuum vessel 2, or the likes.

More specifically, the switchgear is configured including the vacuum valve 1 defined in the above item (1A) or the above item (1B), characterized in that, after the RTV rubber 5 has been applied as a coating around the connection parts between the metal flange 2*a* and the insulating tube 2*b* and between the metal tube 2*e* and the insulating tube 2*b*, the annular electrostatic shield members being electrically conductive and self-contracting in the radial direction of the vacuum valve 1, as are formed of the coiled metal-made shields 4*a* and 4*b* or the likes, are retained on the RTV rubber 5 in the state where they are partially embedded in the RTV rubber 5, before the vulcanization of the RTV rubber 5, and that the resin mold 3 is applied onto the outer peripheral surface of the vacuum vessel 2 after the vulcanization of the RTV rubber 5.

Accordingly, in addition to the advantage stated in the above item (1A) or the above item (1B), the thermal stresses of the edge parts 21*c* can be relaxed, and the appearance of the cracks or the like drawbacks can be arrested, owing to the RTV rubber 5 in which the parts of the annular electrostatic shield members being electrically conductive and self-contracting in the radial direction of the vacuum valve 1, as are formed of the coiled metal-made shields 4*a* and 4*b* or the likes, are embedded.

(1E) In accordance with Embodiment 1 according to this invention, in the configuration in the above item (1C) or the above item (1D), conductive or semi-conductive coating material layers 6 are disposed so as to be conductive with the conductive member including the metal flange 2*a* and the metal tube 2*e*, on at least those parts of the outer peripheral surfaces of the silicone rubber members made of the RTV rubber 5 which touch the annular electrostatic shield members being electrically conductive and self-contracting in the radial direction of the vacuum valve 1, as are formed of the coiled metal-made shields 4*a* and 4*b* or the likes. It is therefore possible to obtain a switchgear including the vacuum valve 1 which prevents the partial discharges infallibly and whose reliability is high, owing to the conductive or semi-conductive coating material layers 6 which are disposed so as to be conductive with the conductive member including the metal flange 2*a* and the metal tube 2*e*, on at least those parts of the outer peripheral surfaces of the silicone rubber members made of the RTV rubber 5 which touch the annular electrostatic shield members being electrically conductive and self-contracting in the radial direction of the vacuum valve 1, as are formed of the coiled metal-made shields 4*a* and 4*b* or the likes.

More specifically, in the vacuum valve 1 defined in the above item (1C) or the above item (1D), there is configured the vacuum valve 1 characterized in that the RTV rubber 5 is of paintable type, that at least those parts of the outer peripheral surfaces of the RTV rubber 5 which touch the annular electrostatic shield members being electrically conductive and self-contracting in the radial direction of the vacuum valve 1, as are formed of the coiled metal-made shields 4*a* and 4*b* or the likes, are coated with the conductive or semi-conductive coating material 6 so as to communicate with the outer peripheral surfaces of the metal flange 2*a* and the metal tube 2*e*, and that the resin mold 3 is applied onto the outer peripheral surface of the vacuum vessel 2 after the drying of the coating material 6.

Accordingly, in addition to the advantage stated in the above item (1C) or the above item (1D), the conductive or semi-conductive coating material 6 is applied as the coating so as to communicate with the outer peripheral surface of the metal flange 2*a*, whereby even in a case where any gap ascribable to a temperature change has appeared between the RTV rubber 5 and the resin mold 3, the coating material 6 adheres onto the side of the resin mold 3, so that the electric field of the gap part can be relaxed, and the occurrence of the partial discharge can be arrested.

(1F) In accordance with Embodiment 1 according to this invention, in the configuration in the above item (1C) or the above item (1D), coupling layers made of a coupling agent 7 are interposed between the outer peripheral surfaces of the silicone rubber members made of the RTV rubber 5 and the resin mold 3. It is therefore possible to obtain a switchgear including the vacuum valve 1 which prevents the partial discharges infallibly and whose reliability is high, owing to the coupling layers made of the coupling agent 7 as are interposed between the outer peripheral surfaces of the silicone rubber members made of the RTV rubber 5 and the resin mold 3.

More specifically, the switchgear is configured including the vacuum valve 1 defined in the above item (1C) or the above item (1D), characterized in that the RTV rubber 5 is of paintable type, that the outer peripheral surfaces of the RTV rubber 5 of the paintable type is coated with the coupling agent 7 so as to communicate with the outer peripheral surface of the insulating tube 2*b*, and that the resin mold 3 is thereafter applied onto the outer peripheral surface of the vacuum vessel 2.

Accordingly, in addition to the advantage stated in the above item (1C) or the above item (1D), the RTV rubber 5 and the resin mold 3 are joined by the coupling agent 7, whereby the appearance of any gap forming a cause for the partial discharge between the RTV rubber 5 and the resin mold 3 can be arrested.

(1G) In accordance with Embodiment 1 according to this invention, a fabrication for a switchgear including a vacuum valve 1 wherein a plurality of electrodes 1*a* and 1*b* movable relative to each other are disposed within a vacuum vessel 2 which is constituted by a conductive member including a metal flange 2*a* and a metal tube 2*e* and an insulating member including an insulating tube 2*b*, and wherein a resin mold 3 is applied onto the outer peripheral surface of the vacuum vessel 2, is characterized in that annular electrostatic shield members being electrically conductive and being expansible and contractible in the radial direction and peripheral direction of the vacuum valve 1, as are formed of coiled metal-made shields 4*a* and 4*b* in each of which a coiled metal wire is brought into an annular shape so as to have an inside diameter smaller than the outside diameter of the vacuum vessel 2, or the likes, are retained in the vicinities of the connection parts between the conductive member including the metal flange 2*a* and the metal tube 2*e* and the insulating member including the insulating tube 2*b*, on the outer peripheral surface of the vacuum vessel 2, in a state where the annular electrostatic shield members hold their compressive forces in the radial direction of the vacuum valve 1, that the annular electrostatic shield members being electrically conductive and being expansible and contractible in the radial direction and peripheral direction of the vacuum valve 1, as are formed of the conductive member including the metal flange 2*a* and the metal tube 2*e* and the coiled metal-made shields 4*a* and 4*b*, or the likes are electrically connected, and that the resin mold 3 is thereafter applied onto the outer peripheral surface of the vacuum vessel 2. It is therefore possible to obtain a method of fabricating a switchgear including the vacuum valve 1 which prevents partial discharges infallibly and whose reliability is high, by applying the resin mold 3 in a state where the annular electrostatic shield members being electrically conductive and being expansible and contractible in the radial direction and peripheral direction of the vacuum valve 1, as are formed of the coiled metal-made shields 4*a* and 4*b* or the likes, are retained in pressed touch with the outer peripheral surface of the vacuum vessel 2.

More specifically, the method of fabricating the switchgear including the vacuum valve 1 is characterized in that, in the vacuum valve 1 defined in the above item (1A), the annular electrostatic shield members being electrically conductive and being expansible and contractible in the radial direction and peripheral direction of the vacuum valve 1, as are formed of the coiled metal-made shields 4*a* and 4*b* in each of which the coiled metal wire is brought into the annular shape so as to have the inside diameter smaller than the outside diameter of the insulating tube 2*b*, or the likes, are retained on that outer peripheral surface of the insulating tube 2*b* which is vicinal to the connection parts between the metal flange 2*a* and the insulating tube 2*b* and between the metal tube 2*e* and the insulating tube 2*b*, that the annular electrostatic shield members being electrically conductive and being expansible and contractible in the radial direction and peripheral direction of the vacuum valve 1, as are formed of the coiled metal-made shields 4*a* and 4*b* or the likes and are retained on those outer peripheral surfaces of the metal flange 2*a* and the metal tube 2*e* which are vicinal to the connection parts between the metal flange 2*a* and the insulating tube 2*b* and between the metal tube 2*e* and the insulating tube 2*b*, are electrically connected, and that the resin mold 3 is thereafter applied onto the outer peripheral surface of the vacuum vessel 2.

Accordingly, it is possible to obtain the method of fabricating the switchgear including the vacuum valve 1 which can relax the electric fields of edge parts 21*d* and which can arrest the occurrences of the partial discharges, in such a way that the annular electrostatic shield members being electrically conductive and being expansible and contractible in the radial direction and peripheral direction of the vacuum valve 1, as are formed of the coiled metal-made shields 4*a* and 4*b* or the likes, are disposed, and that they are electrically connected with the metal-made flange 2*a*.

(1H) In accordance with Embodiment 1 according to this invention, the contents of the method in the above item (1G) are characterized in that silicone rubber made of an RTV rubber 5 is applied as coatings around the connection parts between the conductive member including the metal flange 2*a* and the metal tube 2*e* and the insulating member including the insulating tube 2*b*, that the annular electrostatic shield members being electrically conductive and being expansible and contractible in the radial direction and peripheral direction of the vacuum valve 1, as are formed of the coiled metal-made shields 4*a* and 4*b* or the likes, are subsequently retained after the vulcanization of the silicone rubber made of the RTV rubber 5, and that the resin mold 3 is applied onto the outer peripheral surface of the vacuum vessel 2 after the retention of the annular electrostatic shield members being electrically conductive and being expansible and contractible in the radial direction and peripheral direction of the vacuum valve 1, as are formed of the coiled metal-made shields 4*a* and 4*b* or the likes. It is therefore possible to obtain a method of fabricating a switchgear including the vacuum valve 1 which prevents the partial discharges infallibly and whose reliability is high, in such a way that the annular electrostatic shield members being electrically conductive and being expansible and contractible in the radial direction and peripheral direction of the vacuum valve 1, as are formed of the coiled metal-made shields 4*a* and 4*b* or the likes, are retained on the silicone rubber members made of the RTV rubber 5 as are vulcanized and molded around the connection parts between the conductive member including the metal flange 2*a* and the metal tube 2*e* and the insulating member including the insulating tube 2*b*, on the outer peripheral surface of the vacuum vessel 2.

More specifically, in the method of fabricating the switchgear including the vacuum valve 1 as defined in the above item (1G), the method of fabricating the vacuum valve 1 is characterized in that the RTV rubber 5 is applied as the coatings around the connection parts between the metal flange 2*a* and the insulating tube 2*b* and between the metal tube 2*e* and the insulating tube 2*b*, that the annular electrostatic shield members being electrically conductive and being expansible and contractible in the radial direction and peripheral direction of the vacuum valve 1, as are formed of the coiled metal-made shields 4*a* and 4*b* or the likes, are subsequently retained after the vulcanization of the RTV rubber 5, and that the resin mold 3 is applied onto the outer peripheral surface of the vacuum vessel 2 after the retention of the annular electrostatic shield members being electrically conductive and being expansible and contractible in the radial direction and peripheral direction of the vacuum valve 1, as are formed of the coiled metal-made shields 4*a* and 4*b* or the likes.

Accordingly, in addition to the advantage stated in the above item (1G), the thermal stresses of edge parts 21*c* can be relaxed, and the appearance of cracks or the like drawbacks can be arrested, by the RTV rubber 5.

(1I) In accordance with Embodiment 1 according to this invention, the contents of the method in the above item (1G) are characterized in that silicone rubber made of an RTV rubber 5 is applied as coatings around the connection parts between the conductive member including the metal flange 2*a* and the metal tube 2*e* and the insulating member including the insulating tube 2*b*, that the annular electrostatic shield members being electrically conductive and being expansible and contractible in the radial direction and peripheral direction of the vacuum valve 1, as are formed of the coiled metal-made shields 4*a* and 4*b* or the likes, are subsequently retained in a state where they are partially embedded in the silicone rubber made of the RTV rubber 5, before vulcanization of the silicone rubber made of the RTV rubber 5, and that the resin mold 3 is applied onto the outer peripheral surface of the vacuum vessel 2 after the vulcanization of the silicone rubber made of the RTV rubber 5. It is therefore possible to obtain a method of fabricating a switchgear including the vacuum valve 1 which prevents the partial discharges infallibly and whose reliability is high, in such a way that the annular electrostatic shield members being electrically conductive and being expansible and contractible in the radial direction and peripheral direction of the vacuum valve 1, as are formed of the coiled metal-made shields 4*a* and 4*b* or the likes, are retained in the state where they are partially embedded in the silicone rubber members made of the RTV rubber 5 as are vulcanized and molded around the connection parts between the conductive member including the metal flange 2*a* and the metal tube 2*e* and the insulating member including the insulating tube 2*b*, on the outer peripheral surface of the vacuum vessel 2.

More specifically, in the method of fabricating the switchgear including the vacuum valve 1 as defined in the above item (1G), the method of fabricating the vacuum valve 1 is characterized in that the RTV rubber is applied as the coatings around the connection parts between the metal flange 2*a* and the insulating tube 2*b* and between the metal tube 2*e* and the insulating tube 2*b*, that the annular electrostatic shield members being electrically conductive and being expansible and contractible in the radial direction and peripheral direction of the vacuum valve 1, as are formed of the coiled metal-made shields 4*a* and 4*b* or the likes, are subsequently retained in the state where they are partially embedded in the RTV rubber 5, before the vulcanization of the RTV rubber 5, and that the resin mold 3 is applied onto the outer peripheral surface of the vacuum vessel 2 after the vulcanization of the RTV rubber 5.

Accordingly, in addition to the advantage stated in the above item (1G), the thermal stresses of edge parts 21*c* can be relaxed, and the appearance of cracks or the like drawbacks can be arrested, by the RTV rubber 5 in which the coiled metal-made shields 4*a* and 4*b* are partially embedded.

(1J) In accordance with Embodiment 1 according to this invention, the contents of the method in the above item (1H) or item (1I) are characterized in that the silicone rubber made of the RTV rubber 5 is of paintable type, that at least those parts of outer peripheral surfaces of the silicone rubber which touch the annular electrostatic shield members being electrically conductive and being expansible and contractible in the radial direction and peripheral direction of the vacuum valve 1, as are formed of the coiled metal-made shields 4*a* and 4*b* or the likes, are coated with a conductive or semi-conductive coating material so as to be conductive with the conductive member including the metal flange 2*a* and the metal tube 2*e*, and that the resin mold 3 is applied onto the outer peripheral surface of the vacuum vessel 2 after drying of the coating material. It is therefore possible to obtain a method of fabricating a switchgear including the vacuum valve 1 which prevents the partial discharges infallibly and whose reliability is high, in such a way that at least those parts of the outer peripheral surfaces of the silicone rubber members made of the RTV rubber 5 which touch the annular electrostatic shield members being electrically conductive and being expansible and contractible in the radial direction and peripheral direction of the vacuum valve 1, as are formed of the coiled metal-made shields 4*a* and 4*b* or the likes, are coated with the conductive or semi-conductive coating material layers 6 which are disposed so as to be conductive with the conductive member including the metal flange 2*a* and the metal tube 2*e*.

More specifically, in the vacuum valve 1 defined in the above item (1H) or the above item (1I), the method of fabricating the switchgear including the vacuum valve 1 is characterized in that the RTV rubber 5 is of the paintable type, that at least those parts of the outer peripheral surfaces of the RTV rubber 5 which touch the annular electrostatic shield members being electrically conductive and being expansible and contractible in the radial direction and peripheral direction of the vacuum valve 1, as are formed of the coiled metal-made shields 4*a* and 4*b* or the likes, are coated with the conductive or semi-conductive coating material 6 so as to communicate with the outer peripheral surfaces of the metal flange 2*a* and the metal tube 2*e*, and that the resin mold 3 is applied onto the outer peripheral surface of the vacuum vessel 2 after the drying of the coating material.

Accordingly, in addition to the advantage stated in the above item (1H) or the above item (1I), the conductive or semi-conductive coating material 6 is applied as a coating so as to communicate with the outer peripheral surface of the metal flange 2*a*, whereby the coating material 6 adheres onto the side of the resin mold 3 even in a case where a gap ascribable to a temperature change has appeared between the RTV rubber 5 and the resin mold 3, so that the electric field of the gap part can be relaxed, and the occurrence of a partial discharge can be arrested.

(1K) In accordance with Embodiment 1 according to this invention, the contents of the method in the above item (1H) or item (1I) are characterized in that the silicone rubber made of the RTV rubber 5 is of paintable type, that a coupling agent 7 is applied as a coating onto the outer peripheral surface of the silicone rubber made of the RTV rubber 5 of the paintable type so as to communicate with the outer peripheral surface of the insulating member including the insulating tube 2*b*, and that the resin mold 3 is thereafter applied onto the outer peripheral surface of the vacuum vessel 2. It is therefore possible to obtain a method of fabricating a switchgear including the vacuum valve 1 which prevents the partial discharges infallibly and whose reliability is high, in such a way that a coupling layer which is made of the coupling agent 7 interposed between the outer peripheral surface of the silicone rubber member made of the RTV rubber 5 and the resin mold 3 is applied as the coating.

More specifically, in the vacuum valve 1 defined in the above item (1H) or (1I), the method of fabricating the switchgear including the vacuum valve 1 is characterized in that the RTV rubber is of the paintable type, that the coupling agent 7 is applied as the coating onto the outer peripheral surface of the RTV rubber 5 of the paintable type so as to communicate with the outer peripheral surface of the insulating tube 2*b*, and that the resin mold 3 is thereafter applied onto the outer peripheral surface of the vacuum vessel 2.

Accordingly, in addition to the advantage stated in the above item (1H) or the above item (1I), the RTV rubber 5 and the resin mold 3 are joined by the coupling agent 7, whereby the appearance of any gap forming a cause for the partial discharge between the RTV rubber 5 and the resin mold 3 can be arrested.

Embodiment 2

Figure 3:
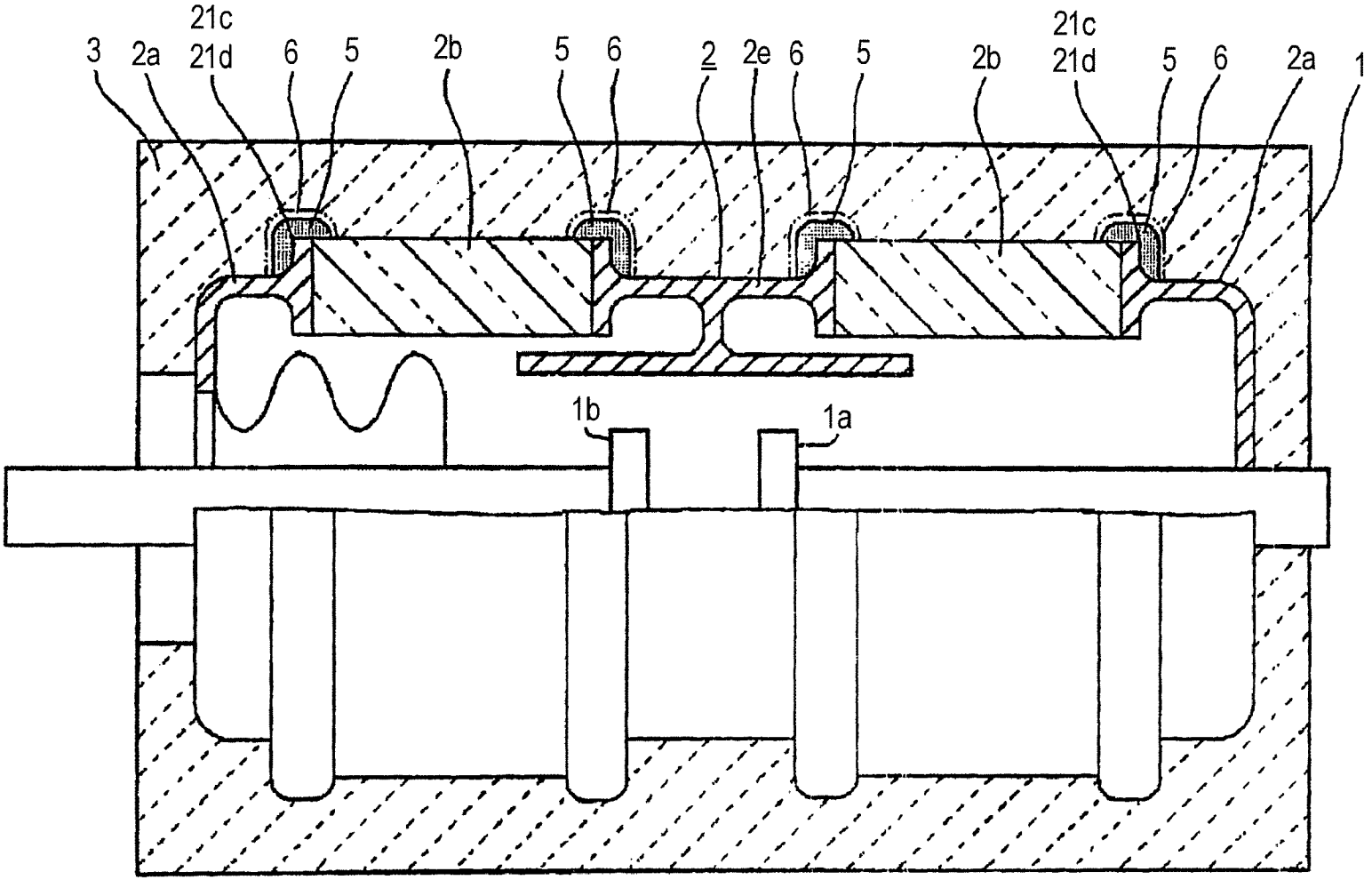
FIG. 3 It is a sectional view, partially cut away, showing the configuration of a switchgear which includes a vacuum valve in Embodiment 2 according to this invention.

Embodiment 2 according to this invention will be described in conjunction with FIG. 3. FIG. 3 is a sectional view, partially cut away, showing the configuration of a switchgear which includes a vacuum valve 1 in Embodiment 2.

In this embodiment 2, regarding a configuration except a peculiar configuration to be described here, the same configurational contents and method contents as in the configuration and method in the foregoing embodiment 1 are included, and they perform similar operations. In the drawings, the same numerals and signs indicate the same or equivalent portions.

Referring to FIG. 3, the vacuum valve 1 is configured of a stationary electrode 1*a* and a movable electrode 1*b*, a vacuum vessel 2 which includes a metal-made flange 2*a* as well as a metal tube 2*e* and a ceramics-made insulating tube 2*b* and in which the electrodes 1*a* and 1*b* are accommodated, and a resin mold 3 being an outer-peripheral insulator which covers the outer peripheral surface of the vacuum vessel 2. Sign 21*c* denotes the thermal stress concentration part of the vacuum vessel 2, and sign 21*d* the electric field concentration part of the vacuum vessel 2.

The edge part 21*c* which protrudes in the outer peripheral direction of the vacuum vessel 2, for example, exists as the part of the outer peripheral surface of the vacuum vessel 2 corresponding to that position of the resin mold 3 which is apprehended to incur a crack or the like drawback due to thermal stress concentration, that is, a part requiring thermal stress relaxation. In order to relax thermal stresses at such thermal stress relaxation-requiring parts, the connection parts between the metal-made flanges 2*a* and the insulating tubes 2*b* are coated with an RTV rubber 5 of paintable type which permits painting onto the surface of this RTV rubber 5 after the vulcanization thereof, and after the vulcanization of the RTV rubber 5, the outer peripheral surfaces of the RTV rubber of the paintable type are coated with a conductive or semi-conductive coating material 6 with which an intenser adhesive force for epoxy is attained than for the RTV rubber, so as to communicate with the outer peripheral surfaces of the metal flanges 2*a*.

Owing to the RTV rubber 5, the thermal stresses of the edge parts 21*c* protruding in the outer peripheral direction of the vacuum vessel 2 as are the thermal stress relaxation-requiring parts are relaxed, thereby to prevent the cracks or the like drawbacks, and even in a case where gaps have appeared between the RTV rubber 5 and the resin mold 3, the coating material 6 applied as coatings so as to communicate with the outer peripheral surfaces of the metal flanges 2*a* adheres onto the side of the resin mold 3, so that the electric fields of the edge parts 21*d* and the gap parts can be relaxed, and the appearance of partial discharges can be arrested.

(2A) In accordance with Embodiment 2 according to this invention, in a switchgear including a vacuum valve 1 wherein a plurality of electrodes 1*a* and 1*b* movable relative to each other are disposed within a vacuum vessel 2 which is constituted by a conductive member including a metal flange 2*a* and a metal tube 2*e* and an insulating member including an insulating tube 2*b*, and wherein a resin mold 3 is applied onto the outer peripheral surface of the vacuum vessel 2; conductive or semi-conductive coating material layers 6 are disposed on the outer peripheral surfaces of silicone rubber made of an RTV rubber 5 of paintable type as is vulcanized and formed on the outer peripheral surfaces of the conductive member including the metal flange 2*a* and the metal tube 2*e* and the insulating member including the insulating tube 2*b*, around the connection parts between the conductive member including the metal flange 2*a* and the metal tube 2*e* and the insulating member including the insulating tube 2*b*, so as to be conductive with the conductive member including the metal flange 2*a* and the metal tube 2*e*, and the resin mold 3 is applied onto the outer peripheral surface of the vacuum vessel 2. It is therefore possible to obtain a switchgear including the vacuum valve 1 which prevents partial discharges infallibly and whose reliability is high, by the conductive or semi-conductive coating material layers 6.

More specifically, the switchgear is configured including the vacuum valve 1 wherein the stationary electrode and the movable electrode are disposed within the vacuum vessel 2 in which the metal flange 2*a* as well as the metal tube 2*e* and the insulating tube 2*b* are connected, and wherein the resin mold 3 is applied onto the outer peripheral surface of the vacuum vessel 2, characterized in that the RTV rubber 5 of the paintable type is applied as coatings onto the outer peripheral surfaces of the metal flange 2*a* as well as the metal tube 2*e* and the insulating tube 2*b*, around the connection parts between the metal flange 2*a* and the insulating tube 2*b* and between the metal tube 2*e* and the insulating tube 2*b*, that after the vulcanization of the RTV rubber 5, the conductive or semi-conductive coating material 6 is applied as coatings onto the outer peripheral surfaces of the RTV rubber 5 of the paintable type so as to communicate with the outer peripheral surfaces of the metal flange 2*a* and the metal tube 2*e*, and that after the drying of the coating material 6, the resin mold 3 is applied onto the outer peripheral surface of the vacuum vessel 2.

Accordingly, owing to the RTV rubber 5, the thermal stresses of the edge parts 21*c* protruding in the outer peripheral direction of the vacuum vessel 2 as are the thermal stress relaxation-requiring parts are relaxed, thereby to prevent cracks or the like drawbacks, and even in a case where gaps have appeared between the RTV rubber 5 and the resin mold 3, the coating material 6 applied as the coating so as to communicate with the outer peripheral surface of the metal flange 2*a* adheres onto the side of the resin mold 3, so that the electric fields of the edge parts 21*d* and the gap parts can be relaxed, and the occurrences of the partial discharges can be arrested.

(2B) In accordance with Embodiment 2 according to this invention, in fabricating a switchgear including a vacuum valve 1 wherein a plurality of electrodes 1*a* and 1*b* movable relative to each other are disposed within a vacuum vessel 2 which is constituted by a conductive member including a metal flange 2*a* and a metal tube 2*e* and an insulating member including an insulating tube 2*b*, and wherein a resin mold 3 is applied onto the outer peripheral surface of the vacuum vessel 2; silicone rubber made of an RTV rubber 5 of paintable type is applied as coatings onto the outer peripheral surfaces of the conductive member including the metal flange 2*a* and the metal tube 2*e* and the insulating member including the insulating tube 2*b*, around the connection parts between the conductive member including the metal flange 2*a* and the metal tube 2*e* and the insulating member including the insulating tube 2*b*, a conductive or semi-conductive coating material 6 is applied as coatings onto the outer peripheral surfaces of the silicone rubber made of the RTV rubber 5 of the paintable type after the vulcanization of the silicone rubber, so as to be conductive with the outer peripheral surfaces of the conductive member including the metal flange 2*a* and the metal tube 2*e*, and the resin mold 3 is applied onto the outer peripheral surface of the vacuum vessel 2 after the drying of the coating material 6. It is therefore possible to obtain a method of fabricating a switchgear including the vacuum valve 1 which prevents partial discharges infallibly and whose reliability is high, in such a way that the conductive or semi-conductive coating material layers 6 are applied as the coatings.

More specifically, the method of fabricating the vacuum valve 1 wherein the stationary electrode and the movable electrode are disposed within the vacuum vessel 2 in which the metal flange 2*a* as well as the metal tube 2*e* and the insulating tube 2*b* are connected, and wherein the resin mold 3 is applied onto the outer peripheral surface of the vacuum vessel 2, is characterized in that the RTV rubber 5 of the paintable type is applied as the coatings onto the outer peripheral surfaces of the metal flange 2*a*, the metal tube 2*e* and the insulating tube 2*b*, around the connection parts between the metal flange 2*a* and the insulating tube 2*b* and between the metal tube 2*e* and the insulating tube 2*b*, that after the vulcanization of the RTV rubber 5, the conductive or semi-conductive coating material 6 is applied as the coatings onto the outer peripheral surfaces of the RTV rubber 5 of the paintable type so as to communicate with the outer peripheral surfaces of the metal flange 2*a* and the metal tube 2*e*, and that after the drying of the coating material 6, the resin mold 3 is applied onto the outer peripheral surface of the vacuum vessel 2.

Accordingly, owing to the RTV rubber 5, the thermal stresses of the edge parts 21*c* protruding in the outer peripheral direction of the vacuum vessel 2 as are the thermal stress relaxation-requiring parts are relaxed, thereby to prevent cracks or the like drawbacks, and even in a case where gaps have appeared between the RTV rubber 5 and the resin mold 3, the coating material 6 applied as the coating so as to communicate with the outer peripheral surface of the metal flange 2*a* adheres onto the side of the resin mold 3, so that the electric fields of the edge parts 21*d* and the gap parts can be relaxed, and the occurrences of the partial discharges can be arrested.

This invention relates to a vacuum valve 1 in which a resin mold 3 is applied onto the outer peripheral surface of a vacuum vessel 2, and a method of fabricating the same, and in more detail, it can be utilized for thermal stress relaxation and electric field relaxation which arrest the occurrences of cracks, partial discharges, etc. that develop in the resin mold 3 when this resin mold 3 has undergone a temperature change.

The invention claimed is:

1. A switchgear including a vacuum valve in which a plurality of electrodes movable relative to each other is disposed within a vacuum vessel constituted by a conductive member and an insulating member, and a resin mold is applied onto an outer peripheral surface of the vacuum vessel, wherein an annular electrostatic shield member which contracts in its radial direction is retained on the outer peripheral surface of the vacuum vessel so as to relax an electric field of an electric field relaxation-requiring part of the vacuum vessel;

wherein:

a shield member, in which at least two rings each having a coiled metal wire in an annular shape are electrically connected, is employed as the electrostatic shield member; and the electrostatic shield member is joined onto the outer peripheral surface of the vacuum vessel by a contracting force of the electrostatic shield member.

2. A switchgear as defined in claim 1, wherein the electrostatic shield member is retained on a silicone rubber member which is vulcanized and molded around a connection part between the conductive member and the insulating member.

3. A switchgear as defined in claim 1, wherein a silicone rubber member which is vulcanized and molded in a state where part of the electrostatic shield member is embedded therein is disposed around a connection part between a conductive member and an insulating member.

4. A switchgear as defined in claim 2, wherein a conductive or semi-conductive coating material layer is disposed so as to be conductive with the conductive member, on at least that part of an outer peripheral surface of the silicone rubber member which touches the electrostatic shield member.

5. A switchgear as defined in claim 2, wherein a coupling layer made of a coupling agent is interposed between an outer peripheral surface of the silicone rubber member and the resin mold.

6. A method of fabricating a switchgear including a vacuum valve in which a plurality of electrodes movable relative to each other is disposed within a vacuum vessel which is constituted by a conductive member and an insulating member, and a resin mold is applied onto an outer peripheral surface of the vacuum vessel; wherein an annular electrostatic shield member, comprised of at least two rings each of which is expansible and contractible in a radial direction and endowed with an inside diameter smaller than an outside diameter of the vacuum vessel, is retained in the vicinity of a connection part between the conductive member and the insulating member, on the outer peripheral surface of the vacuum vessel, in a state where the annular electrostatic shield member holds its compressive force in the radial direction, the conductive member and the electrostatic shield member are electrically connected, and the resin mold is thereafter applied onto the outer peripheral surface of the vacuum vessel, wherein a first of said rings is disposed on the conductive member, and a second of said rings is disposed on the insulating member and extends radially outwardly farther than said first ring and said conductive member.

7. A method of fabricating a switchgear including a vacuum valve as defined in claim 6, wherein silicone rubber is applied as a coating around the connection part between the conductive member and the insulating member, the electrostatic shield member is subsequently retained in a state where it is partially embedded in the silicone rubber, before vulcanization of the silicone rubber, and the resin mold is applied onto the outer peripheral surface of the vacuum vessel after the vulcanization of the silicone rubber.

8. A method of fabricating a switchgear including a vacuum valve in which a plurality of electrodes movable relative to each other is disosed within a vacuum vessel which is constituted by a condutive mamber and an insulating member, and a resin mold is applied onto an outer peripheral surface of the vacuum vessel; wherein an annular electrostatic shield member, comprised of at least two rings each of which is expansible and contractible in a radial direction and endowed with an inside diameter smaller than an outside diameter of the vacuum vessel, is retained in the vicinity of a connection part between the conductive member and the insulating member, on the outer peripheral surface of the vacuum vessel, in a state where the annular electrostatic shield member holds its compressive force in the radial direction, the conductive member and the electrostatic shield member are electrically connected, and the resin mold is thereafter applied onto the outer peripheral surface of the vacuum vessel, wherein silicone rubber is applied as a coating around the connection part between the conductive member and the insulating member, the electrostatic shield member is subsequently retained after vulcanization of the silicone rubber, and the resin mold is applied onto the outer peripheral surface of the vacuum vessel after the retention of the electrostatic shield member.

9. A method of fabricating a switchgear including a vacuum valve as defined in claim 8, wherein the silicone rubber is of paintable type, at least that part of an outer peripheral surface of the silicone rubber which touches the electrostatic shield member is coated with a conductive or semi-conductive coating material so as to be conductive with the conductive member, and the resin mold is applied onto the outer peripheral surface of the vacuum vessel after drying of the coating material.

10. A method of fabricating a switchgear including a vacuum valve as defined in claim 8, wherein the silicone rubber is of paintable type, a coupling agent is applied as a coating onto an outer peripheral surface of the silicone rubber of the paintable type so as to communicate with an outer peripheral surface of the insulating member, and the resin mold is thereafter applied onto the outer peripheral surface of the vacuum vessel.

11. A switchgear including a vacuum valve in which a plurality of electrodes movable relative to each other is disposed within a vacuum vessel constituted by a conductive member and an insulating member, and a resin mold is applied onto an outer peripheral surface of the vacuum vessel; wherein a conductive or semi-conductive coating material layer is disposed so as to be conductive with the conductive member, on an outer peripheral surface of silicone rubber of paintable type as is vulcanized and formed on outer peripheral surfaces of the conductive member and the insulating member, around a connection part between the conductive member and the insulating member, and the resin mold is applied onto the outer peripheral surface of the vacuum vessel.

12. A method of fabricating a switchgear including a vacuum valve in which a plurality of electrodes movable relative to each other is disposed within a vacuum vessel which is constituted by a conductive member and an insulating member, and wherein a resin mold is applied onto an outer peripheral surface of the vacuum vessel; wherein silicone rubber of paintable type is applied as a coating onto outer peripheral surfaces of the conductive member and the insulating member, around a connection part between the conductive member and the insulating member, after vulcanization of the silicone rubber, a conductive or semi-conductive coating material is applied as a coating onto an outer peripheral surface of the silicone rubber of the paintable type, so as to be conductive with the outer peripheral surface of the conductive member, and after drying of the coating material, the resin mold is applied onto the outer peripheral surface of the vacuum vessel.

* * * * *